US006751521B2

(12) United States Patent
Kontani

(10) Patent No.: US 6,751,521 B2
(45) Date of Patent: Jun. 15, 2004

(54) INFORMATION DISPLAY APPARATUS OF A LOOM

(75) Inventor: Hideyuki Kontani, Ishikawa-ken (JP)

(73) Assignee: Tsudakoma Kogyo Kabushiki Kaisha (JP)

( * ) Notice: Subject to any disclaimer, the term of this patent is extended or adjusted under 35 U.S.C. 154(b) by 0 days.

(21) Appl. No.: 10/632,994

(22) Filed: Aug. 1, 2003

(65) Prior Publication Data

US 2004/0039474 A1 Feb. 26, 2004

(30) Foreign Application Priority Data

Aug. 26, 2002 (JP) ..... 2002-245384

(51) Int. Cl.[7] ..... G06F 19/00; D03D 51/00
(52) U.S. Cl. ..... 700/140; 139/1 R
(58) Field of Search ..... 700/140, 143, 700/141, 130; 139/1 R, 319; 340/825.52

(56) References Cited

U.S. PATENT DOCUMENTS 4,943,927 A * 7/1990 Yarita et al. ..... 700/140
5,276,627 A * 1/1994 Makino et al. ..... 700/140
6,513,554 B1 * 2/2003 Hellström et al. ..... 139/1 R

FOREIGN PATENT DOCUMENTS

| | | |
|---|---|---|
| EP | 0 589 830 A | 3/1994 |
| EP | 1 186 977 A | 3/2002 |
| JP | 05 078954 A | 3/1993 |

* cited by examiner

*Primary Examiner*—Peter Nerbun
(74) *Attorney, Agent, or Firm*—Webb Ziesenheim Logsdon Orkin & Hanson, P.C.

(57) ABSTRACT

The information display apparatus is characterized by storing at least plural pieces of loom information, by comprising: data control means capable of outputting the stored loom information; display means for displaying in a screen the loom information outputted from data control means; and distinction means for distinguishing a kind of a person engaged in weaving and outputting a distinction result in the data control means, and by presetting in the data control means the item for display corresponding to the distinction result, thereby outputting the loom information relative to the item for display corresponding to the distinction result from the data control means to the display means.

7 Claims, 5 Drawing Sheets

INFORMATION DISPLAY APPARATUS OF A LOOM

BACKGROUND OF THE INVENTION

1. Field of the Invention

The present invention relates to a device for displaying loom information according to kinds of persons engaged in weaving such as weaving workers, maintenance workers, superintendents and the like.

2. Description of Prior Art

For improvement in weaving efficiency, it is usually done to visually display in an information display unit provided in a loom such as various pieces of information concerning weaving such as information on cloth production volume like a rate of loom operation, a woven length, etc., and information representing actual operating state like a frequency of stoppage, state of getting into trouble, running state of weft, state of warp tension, etc.

The techniques of Japanese Patent Appln. Public Disclosure (KOKAI) Nos. 6-81251 and 5-78954 are known as ones of such displays of information. In these types of displays, items for display are predetermined per kind of persons engaged in weaving, and a worker inputs necessary loom information by using an operation switch to display the information corresponding to the operation switch.

In these techniques, however, since a person engaged in weaving should designate an item to be displayed (item for display) to obtain loom information needed by the person, such a switching operation is troublesome, and such an operation is made every time the person does the round, which shortens the life of the operation switch.

SUMMARY OF THE INVENTION

An object of the present invention is to reduce the frequency of operation required for switching to display to the least possible number when a person confirms necessary loom information in the display.

The information display apparatus of a loom, comprising data control means storing at least a plurality of pieces of loom information and capable of outputting the stored loom information, display means for displaying in a screen the loom information to be outputted from said data control means, and distinction means for distinguishing a kind of a person engaged in weaving and outputting a distinction result to said data control means. In the data control means are preset items for display corresponding to the distinction result, and the data control means outputs the loom information concerning the loom information relative to the item for display corresponding to the distinction result.

When a person engaged in weaving approaches the loom, or when a storage medium such as an ID card carried by the person is inserted into the distinction means, a distinction result representing the kind of the person is outputted from the distinction means. Thereby, since the data control means outputs the loom information concerning the item for display corresponding to the distinction result, the loom information corresponding to the item for display is visually displayed in the display means.

Consequently, according to the present invention, there is no need for switching operation of the display unit as heretofore done by hand, so the switching operation of the display unit is omitted. Further, as the frequency of operating the display unit decreases, the life of the operation switch and the like become long that much.

Incidentally, the "loom information" means information necessary for controlling operation of each loom, which can be represented in an identifiable form by specific numerical values, letters and graphs of: for example, (a) a weaving condition of the loom such as set values to be set in a loom controlling device such as a weft insertion device or a warp tension control unit; (b) a weft running state (arrival timing of the weft) into the shed during running of the loom, state of warp tension (actual tension value), actual detection value by a sensor such as a weft detection state (waveform of a feeler signal) by a weft feeler and its signal waveform relative to the time base; further, (c) an actual operating condition state of the loom such as, for example, a numerical value relative to the operating state of the loom like the operation rate of the loom per unit period, frequency of stoppage, woven length (the number of weft insertion picks), etc.; (d) detailed information relative to a history of occurrence of troubles such as the contents and the time and date of failures and troubles; and detailed information relative to a state of practicing a maintenance work such as a date when oiling and cleaning of parts are done.

On the other hand, the "item for display" includes a denomination corresponding to the loom information. Concretely, in the example of displaying the operation rate of the loom, the value of the operation rate calculated over an hour in the past is the "loom information" and the operation rate per hour which is the denomination corresponding to this value of operation rate is the "item for display."

In the foregoing information display unit, the distinction means can include a detected element carried by a person engaged in weaving and representing the kind of the carrier, and a distinction portion for distinguishing the detected element.

The detected element can include a portable transmitter for generating a signal showing the kind of a carrier, and the distinction portion can include a signal receiving circuit for receiving the signal from the portable transmitter, and a discrimination circuit for discriminating the kind of the portable transmitter on the basis of the received signal of the signal receiving circuit.

It is, however, possible to use as the detected element a storage medium in which the kind of the worker is recorded, to read the memory information from the storage medium and to discriminate the kind of the worker in the discrimination circuit on the basis of the read memory information.

It is also possible to utilize as the detected element an appearance of a person engaged in weaving, such as work clothes and a cap, to make the distinction portion detect the color of the clothes of the person by a color sensor, and to discriminate the kind of the person on the basis of the detection result of the color sensor by discrimination circuit.

In the foregoing information display unit, it is possible to prepare a plurality of the detected elements according to the kind of a person for the distinction portion to discriminate the kind of the detected element. In this case, each worker carries the portable transmitter corresponding to the kind of the worker.

In the foregoing information display unit, the distinction means can include a sensor for detecting physical characteristics such as the person's fingerprints, height, etc., and a distinction circuit for distinguishing the kind of the person from a group of previously registered data.

Another information display apparatus of a loom: comprising data control means storing at least plural pieces of loom information and capable of outputting the stored loom information; display means for displaying in a screen the loom information to be outputted from said data control means; transmission means, in which at least one of items for display is stored, for transmitting the item for display and provided for a person engaged in weaving to carry; and discrimination means for discriminating the item for display upon receipt of a transmission signal from said transmission means. The data control means outputs the loom information relative to the item for display corresponding to the discrimination result by the discrimination means.

In the above mentioned information display unit, when a person carrying the transmission means approaches to the loom, a distinction result representing the kind of the person is outputted from the discrimination means. Since this makes the data control means output the loom information relative to the item for display corresponding to the distinction result, the loom information corresponding to the item for display on the kind of the person is visually displayed in the display means. Accordingly, there is no need for any switching operation of displaying which has been manually done, so that the switching operation can be omitted. Further, the less frequently the operation to the display unit is required, the life operation switch will become longer.

The transmission means can store a plurality of items for display to output any of the items for display selectively, and the discrimination means may be made to discriminate the selected item for display from the received signal.

PREFERRED EMBODIMENTS OF THE INVENTION

Figure 1:
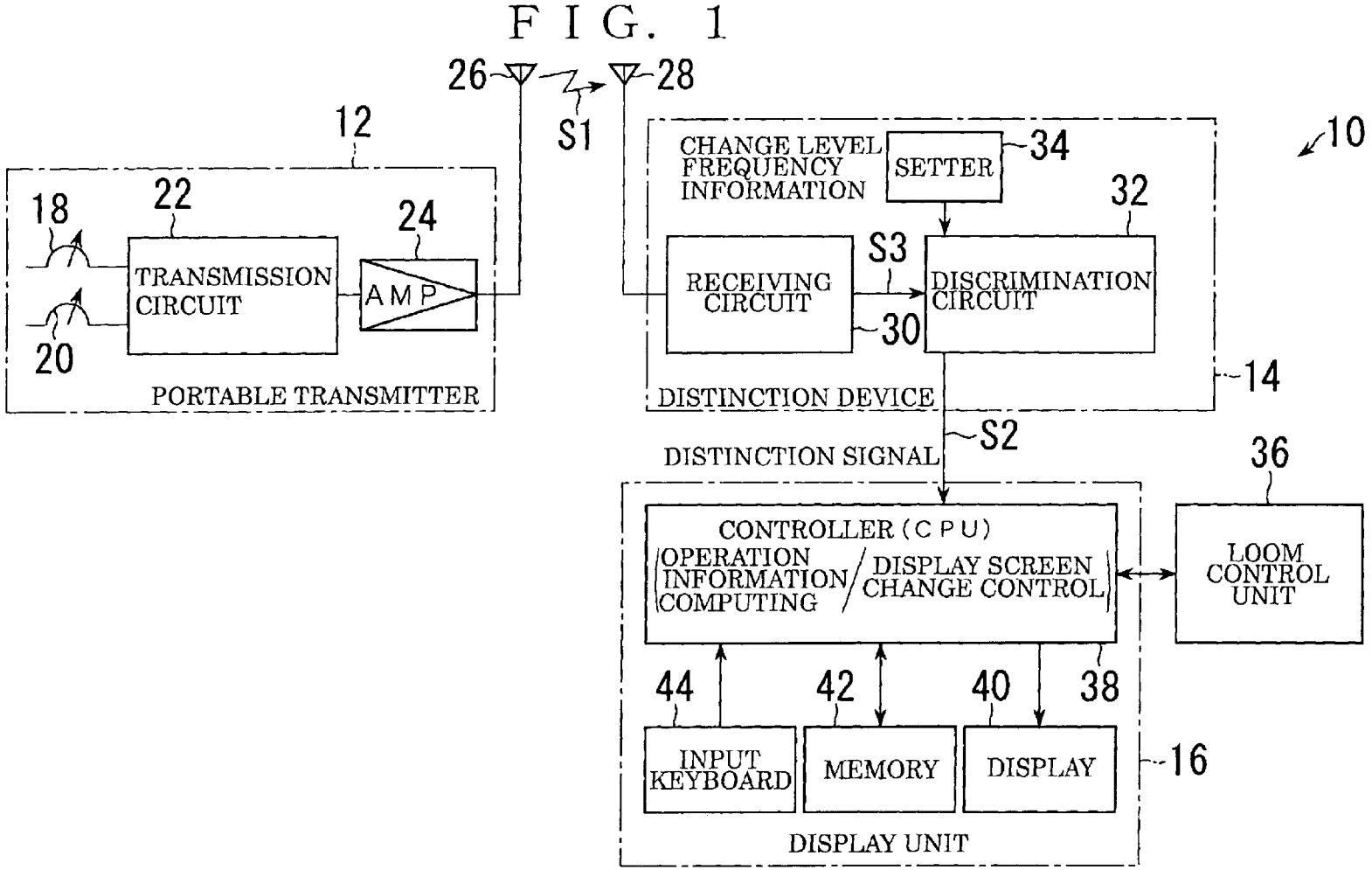
FIG. 1 is a block diagram of an electric circuit showing an embodiment of the information display unit according to the present invention.
Figure 2:
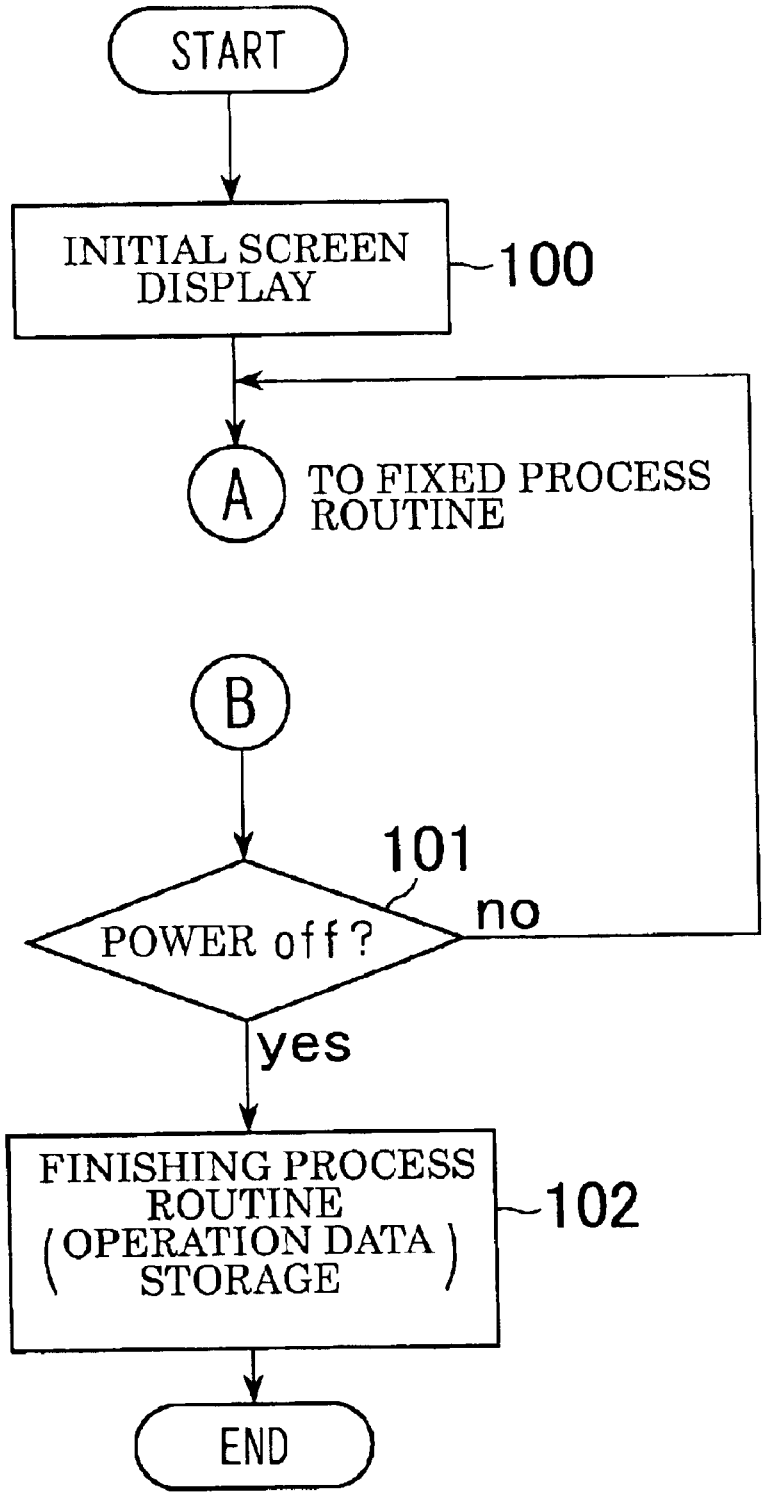
FIG. 2 is a schematic drawing for explaining the motion of the information display unit shown in FIG. 1.
Figure 3:
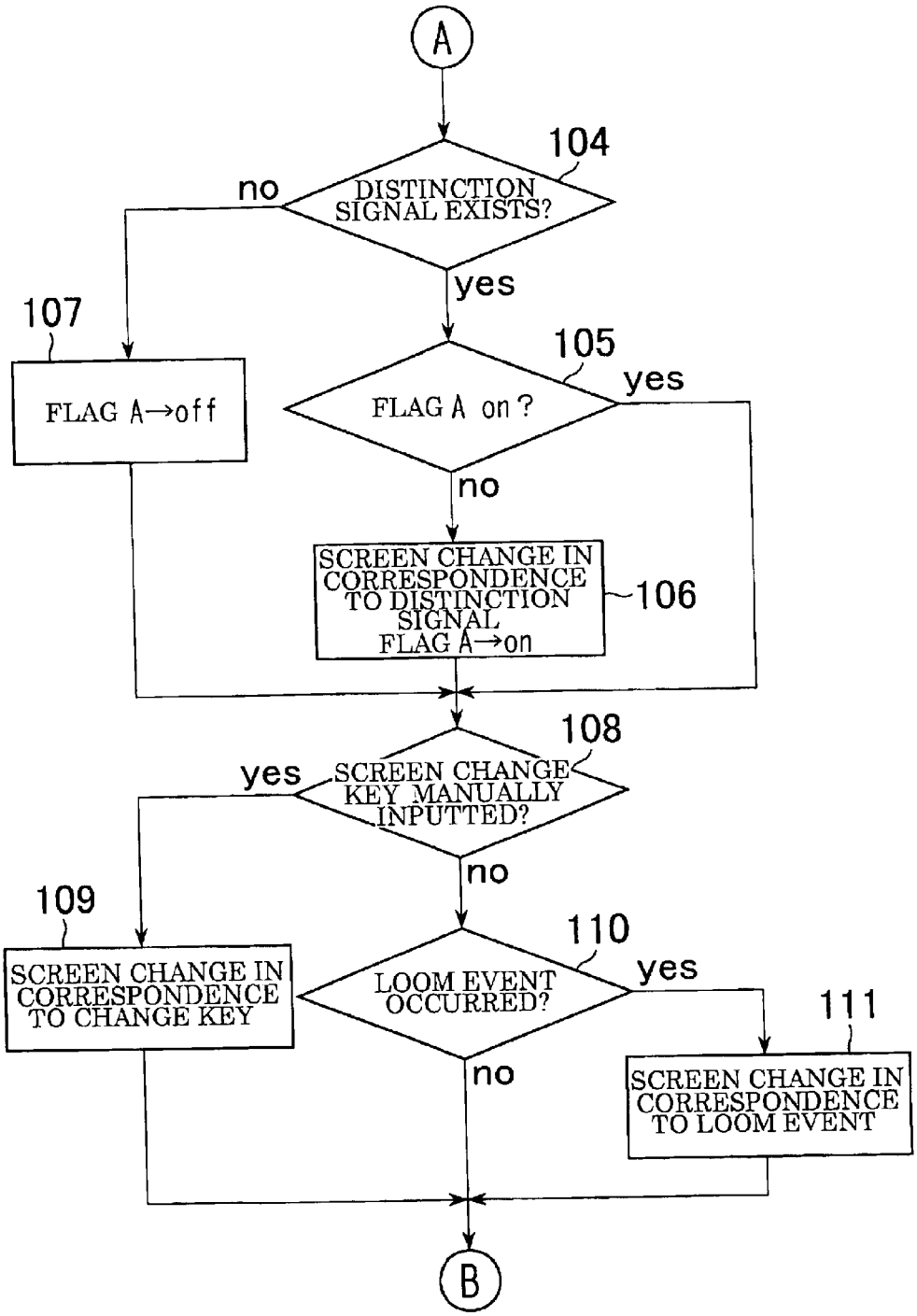
FIG. 3 is a schematic drawing for explaining the motion following FIG. 2.

Referring to FIGS. 1–3, the information display apparatus 10 of a loom comprises: a plurality of portable transmitters 12 respectively transmitting a signal S1 representing a kind (kind of occupation) of a person engaged in weaving; a distinction device 14 for outputting a distinction signal S2 representing the kind of the person on the basis of the transmit signal S1 from the portable transmitter 12; and a display unit 16 for visually displaying the data of the item for display corresponding to the distinction signal S2 on the basis of the distinction signal S2 outputted from the distinction device 14.

In the illustration, the portable transmitter 12 constitutes, together with the distinction device 14, the above-mentioned distinction means. The portable transmitter 12 is, for example, assigned to respective kinds of persons engaged in weaving such as weaving workers (weavers) who actually perform weaving, maintenance managers (maintenance workers) who are in charge of maintenance, checking or reparation, managerial persons and so forth, individually, and carried by the persons engaged in weaving of the assigned kinds. In contrast, the distinction device 14 and the display unit 16 are provided on the loom side.

In each portable transmitter 12, an output level of the signal S1 is set in a level setter 18, a radio wave frequency of the signal S1 is set in a frequency setter 20, a signal having the set output level and frequency is transmitted from a transmission circuit 22, after the generated signal is amplified in an amplifier 24, and the amplified signal is transmitted from a transmission antenna 26 as the transmit signal S1 which is the radio signal.

The level of the transmit signal S1 from each portable transmitter 12 can be adjusted and set by using the level setter 18. The frequency of the transmit signal S1 is of the value assigned to the kind of a carrier of the portable transmitter or a person engaged in weaving, and can be adjusted and set by the carrier, using the frequency setter 20.

In the illustration, the transmit signal S1, for example, is a feeble radio wave. The transmit signal S1, however, may be another kind of signal such as a sound wave or light.

The distinction device 14 receives the transmit signal S1 received by a receiving antenna 28 in a receiving circuit 30. The receiving circuit 30, amplifying the received signal, outputs it as a signal S3 to a discrimination circuit 32.

The discrimination circuit 32 distinguishes the kind represented by the input signal S3 from the receiving circuit 30 on the basis of various conditions of discrimination set in a setter 34 and outputs the distinction signal S2 representing the distinguished kind as a distinction result to the display unit 16.

It is possible to make the distinction in the discrimination circuit 32 discriminate, for example, whether or not the level of the input signal S3 is within the threshold of the signal level as well as whether or not the frequency of the input signal S3 is at least one of a plurality of reference frequencies assigned to the kind, and as a result of those discriminations, when the level of the input signal S3 is within the threshold and the frequency of the input signal S3 is at least one of the reference frequencies, to output the distinction S2 representing the kind.

In detail, the threshold of the signal level can be set, taking into consideration of the receiving level of the transmit signal S1, the distance between the portable transmitter 12 and the distinction device 14, and more particularly, the distance between adjacent looms, the rate of amplification, etc. within the receiving circuit 30. For example, the threshold of the signal level can be set so that the existence of the carrier of the portable transmitter 12 can be distinguished within several meters from the receiving antenna 28.

Whether or not the frequency of the input signal S3 to the discrimination circuit 32 is at least one of a plurality of reference frequencies assigned to the kind can be discriminated by converting the frequency of the input signal S3 into a voltage corresponding to the frequency, and by comparing the converted voltage level with various reference voltage levels different from each other, and discriminating whether or not the converted voltage level corresponds to at least one of reference voltage levels.

Therefore, the threshold of the signal level and the reference frequency (reference voltage level) per kind are set in the setter 34.

The reference frequency (reference voltage level) per kind can be a voltage level corresponding to the frequency assigned to every kind such as X1 Hz (x1V) for the weaving worker, X2 Hz (x2V) for the maintenance worker, and X3 Hz (x3V) for the manager.

The display unit 16 has a controller 38 composed by a CPU and the like, a memory 42 for storing operation information such as a software program for the controller 38 to process and a loom information as a result of processing, a keyboard 44 for inputting necessary information such as a weaving condition necessary for actuating the loom, and a display 40 for displaying in a screen the loom information as a result of processing of the controller 38.

The foregoing data control means is correspond to the controller 38, and the memory 42 and the display means is correspond to the display 40.

More particularly, data necessary for operation the operating information of the loom are received in the controller 38 from a loom control unit 36. The controller 38 determines the operation information of the loom on the basis of the received data according to a memory software, and stores it in the memory 42 in correspondence to the items for display. On the other hand, in the memory 42 are inputted and stored through the controller 38 the items for display of the loom information set through the keyboard 44 and the like in advance and to be displayed for each distinction signal S2 (each kind of the persons engaged in weaving).

The display unit 16, when the distinction signal S2 is inputted, read out the loom information relative to the item for display corresponding to the inputted distinction signal from the memory 42 and visually displays in the display 40.

The display unit 16 can also, by display switching operation from the keyboard 44, read out the loom information relative to the item for display corresponding to a switching command to be inputted to the controller 38, and visually display in the display 40. By this, the loom information displayed in the display 40 is changed over.

The display unit 16 is constituted to be able to input the control data such as a weaving condition and the like to the loom control unit 36 in an interactive mode and to be able to send and receive the data with the loom control unit 36. Thereby, persons engaged in weaving can input necessary set values through the keyboard 44 and visually confirm the content of the set values through the display 40.

Further, the display unit 16, when such an event as end breaking, weft insertion failure and the like occur to the loom, receives such event information from the loom control unit 36 to the controller 38 and visually indicates the received event information immediately in the display 40. By as doing, information displayed on the display 40 is switched over.

As weaving conditions, a target value of a weft insert condition and its actual value such as those of a jet timing from a weft insert nozzle, a warp condition and its target value such as a target value and its actual value of the warp tension, a target value and its actual value of weft density as well as an expected time until the weaving is finished, can be enumerated.

As operation information, data of stoppage such as the operation rate, length of weaving, frequency of stoppage per unit hour, state of occurrence of trouble, signals of an actual operating state of each machine and device of the loom, for example, a feeler signal waveform and the like showing a state of detecting a yarn by a weft feeler, can be enumerated.

The display unit 16 computes, on the basis of signals and data fed from the loom control unit 36, the operation information such as operating (weaving) time, frequency of stoppage, stopping time, length of weaving, etc., per unit period (or unit transfer) according to the software program stored in the memory 42, and stores the computed operation information in the memory 42 in correspondence to the items for display.

In the loom information concerning such items for display as mentioned above, the operation information such as the operating time, frequency of stoppage, stopping time, length of weaving, etc., per unit period can be mainly used by a manager in charge of the weaving process so as to catch the operating state of the loom. It is, however, possible to compute these pieces of operation information by the loom control unit 36 instead of the display unit 16 and supply them to the controller 38.

The target value and the actual value respectively of the weft insert condition such as the target value and the actual value of the jet timing from the weft insert nozzle, the warp condition and its actual value such as the target value and the actual value of the warp tension, the target value and the actual value of the weft density, the actual detailed state such as the data of stoppage, the state of occurrence of a trouble, the waveform of a feeler signal and the like can be used by a maintenance worker in charge of adjustment of the loom for restoration of the stoppage or maintenance of the loom.

The kind of a person engaged in weaving may be either the kind of occupation or the item for display itself desired by the person. It is also possible to divide the kinds of persons engaged in weaving further not only into weaving workers, maintenance workers for restoring a cause of stoppage such as warp breaking or warp stop and managers but also into cloth cutting workers, looming workers or the like, or the kinds of persons engaged in weaving may be individually defined. Or, on the contrary, it may be simplified such as persons engaged in weaving and other persons concerned (including managers and maintenance workers). The expected time till the finish of weaving may be used by the looming workers or cloth cutting workers.

In the following is explained, with reference to FIGS. 2 and 3, internal processing by the display unit 16 (mainly the controller 38) in the case where the portable transmitter 12 is individually assigned to each kind of persons engaged in weaving (maintenance worker, manager) except weaving workers.

Referring to FIG. 2, when a power switch is turned on, the display unit 16 displays an initial screen (step 100) and transfers to a fixed process routine (A). Then, the display unit 16 judges whether the power switch was turned off or not (step 101).

As a result of judgment in step 101, if the switch is not turned off, the display unit 16 returns to the fixed process routine W). However, when the switch is turned off, the display unit 16 carries out a finishing process routine (step 102) of storing operation data and the like and then finishes the process.

By the way, if a carrier of the portable transmitter 12 is not within the range of a certain distance from the distinction device 14, particularly from the receiving antenna 28, the level of the signal S3 does not reach the threshold level, so that the discrimination circuit 32 does not input the distinction signal S2 to the display unit 16.

However, if the carrier of the portable transmitter 12 is within a certain distance from the distinction device 14, particularly from the receiving antenna 28, the distinction device 14 receives the transmit signal S1 and the level of the signal S3 exceeds its threshold level, so that the discrimination circuit 32 outputs the distinction signal S2 corresponding to the signal S1 to the display unit 16.

Referring to FIG. 3, in the fixed process routine to be carried out in the controller 38, the display unit 16 firstly judges whether the distinction signal S2 is inputted or not (step 104).

As a result of the judgment in step 104, when the distinction signal S2 is inputted, the display unit 16 judges whether a flag A showing that the screen of the display 40 has already been changed by the distinction signal S2 is ON or not (step 105).

As a result of the judgment in step 105, if the flag A is not turned on, the display unit 16 changes the screen corresponding to the distinction signal S2 and turns the flag A on (step 106). By this, the loom information relative to the item for display corresponding to the distinction signal S2 is read out from the memory 42 and visually displayed in the display 40. This step is followed by step 108 which is a starting step of an event process routine.

As a result of the judgment in step 105, if the flag is turned on, the loom information relative to the item for display corresponding to the distinction signal S2 has already been displayed in the display 40, so that, while keeping the present displaying as it is, the display unit 16 transfers to step 108 which is the starting step of the event process routine.

Further, as a result of the judgment in step 104, if the distinction signal S2 is not inputted, the display unit 16 turns off the flag A (step 107). By this, the displaying of the loom information corresponding to the item for display is finished, and the screen returns to the fixed screen display. Thereafter, the display unit 16 transfers to the event process routine.

In the event process routine, the display unit 16 judges whether a screen changing command to be generatated by that a screen changing key of the keyboard 44 is operated manually by a person engaged in weaving is inputted or not (step 108).

As a result of the judgment in step 108, if the screen changing command is inputted, the display unit 16 changes the screen of the display 40 to a screen corresponding to the operated changing key (changing command) (step 109). By this, the screen corresponding to the changing command is displayed in the display 40. Then, the display unit 16 returns to step 101 in FIG. 2.

However, as a result of the judgment in step 108, if the screen changing command is not inputted, the display unit 16 judges whether such an event as yarn breakage, failure in weft insertion or the like has occurred in the loom or not (step 110).

The judgment in step 110 can be performed when receiving the information that the event was generated to the loom in the controller 38 from the loom control unit 36, storing in the memory 38 the kind and circumstances, etc., of the event which occurred, and judging whether such an event is stored or not.

As a result of the judgment in step 110, if the event has not occurred, the display unit 16 returns to step 101 in FIG. 2.

As a result of the judgment in step 110, if the event has occurred, the display unit 16 changes the screen of the display 40 to a screen corresponding to the event which occurred (step 111). By this, the contents of the event which occurred are displayed in the display 40. Then, the display unit 16 returns to step 101 in FIG. 2.

Thus, while the power switch is on, the display unit 16 repeats performing the processes between step 104 and step 101, thereby enabling to change display screens in correspondence to whether the distinction signal is generated or not, whether a command to change screens is inputted from the keyboard 44 or not, and whether there was a loom event or not.

When a person engaged in weaving who carries the portable transmitter approaches the loom, the distinction device 14 receives the signal S1 from the portable transmitter 12 and outputs the corresponding distinction signal S2 to the display unit 16 on the loom side. Receiving it, the display unit 16 performs step 106 in FIG. 3 and displays the information of the item for display corresponding to the distinction signal (i.e., the kind of the person engaged in weaving) in the display 40. By this, the person engaged in weaving can see desired loom information without performing any operation to change screens with respect to the display unit 16.

A manager, for example, can become aware of a state of operation of the loom by confirming the information relative to the operation rate, production volume of a cloth such as weaving length and the like. A maintenance worker can become aware of a state of operation of the loom by confirming the frequency of stoppage of the loom, a state of occurrence of a trouble, a state of weft running, a state of warp tension, a state of signal of the weft feeler and the like.

Weaving workers who restore yarn breakage or failure in weft insertion, confirming the displaying of a cause for stoppage to be displayed correspondingly, can re-operate the loom by promptly restoring it. It is also desirable to have each weaving worker carry the portable transmitter 12. However, in case the loom-side display unit 16 is programmed so as to indicate a cause for stoppage automatically after it occurred, it is not necessary for the weaving workers to carry the portable transmitter 12.

If a manager goes the round in a weaving factory, when an operation rate of a loom is the information required, the display 40 displays on the screen a computed operation rate value or "88.5%" which is the loom information alongside of, for example, the name of the loom information or the item for display "operation rate of loom." Concerning the displaying of the loom information, it is possible not only to have a numerical value directly displayed but also to make the displaying with higher visibility, for example, to graph the operation rate relative to the time axis so as to facilitate understanding of a change with a lapse of time. It is also possible to indicate the loom information as a concrete content of a trouble such as breakdown trouble information by a letter or a trouble code (numeral), and more preferably, to display the date and time, too, when the trouble occurred, as the loom information or to display a plurality of pieces of breakdown trouble information alongside in the order of time series, without restriction in a concrete method of displaying of the loom information.

Any persons engaged in weaving can, if necessary, operate the keyboard 44 manually to change the display screen and read out detailed loom information from the memory 42 by having the display 40 display it, so that any person engaged in weaving can confirm the loom information corresponding to other items for display and take a next action (e.g., working).

According to the foregoing information display apparatus 10, while going the rounds of a plurality of looms, if the person engaged in weaving moves from a loom within a predetermined distance, the distinction device 14 distinguishes the transmit signal S1 from the portable transmitter 12 and outputs the distinction signal S2 to the display unit 16. Therefore, without any operation to change the screen relative to the display unit 16, a display screen required by the person is automatically displayed; therefore, the working efficiency is remarkably higher than when a worker has to change the display screen manually.

In the foregoing embodiment, the portable transmitter 12 which generates a signal is used as a detected element, but something that does not generate a signal, e.g., a storage medium such as an ID card in which the kind of a person engaged in weaving is recorded can be used as a detected element, to read storage information from the storage medium in a distinction circuit by a reader and to discriminate the kind on the basis of the read storage information.

It is also possible to utilize clothing, particularly, work clothes of the person engaged in weaving as a detected element, to detect the color of the clothing of the person by a color sensor, and to discriminate the kind of the person on the basis of the detection result of the color sensor.

Further, it is possible to utilize physical features such as the fingerprints, height or the like of a person engaged in weaving as a detected element, to detect the physical features in the distinction circuit by a sensor, and to distinguish the kind of the person from a group of previously registered data on the basis of the detection data of the sensor.

Figure 4:
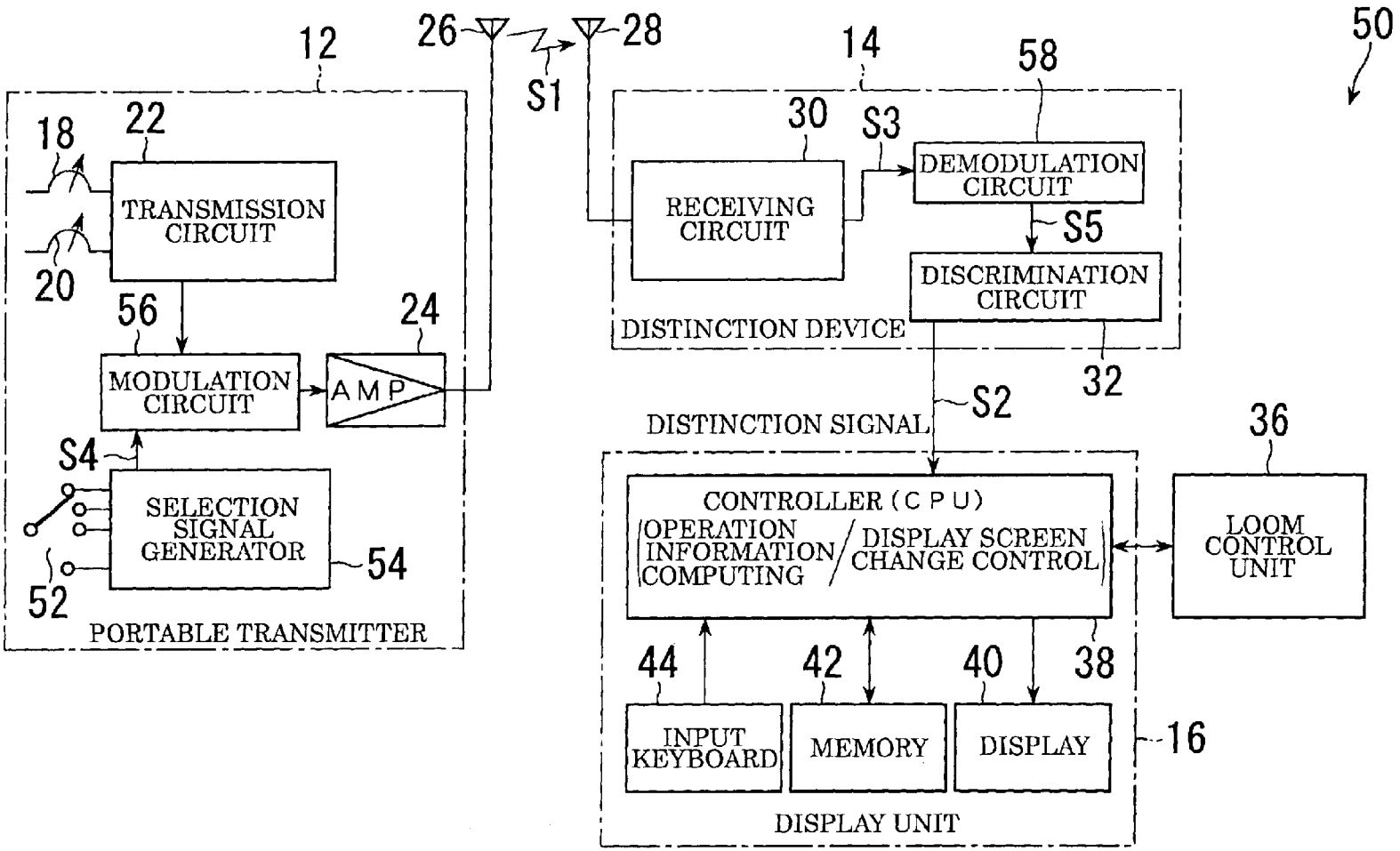
FIG. 4 is a block diagram of an electric circuit showing an embodiment of another information display unit according to the present invention.

Referring to FIG. 4, an information display apparatus 50 is provided, in the portable transmitter 12 as a detected element, with an item selector 52 for selectively setting an item for display desired by the person engaged in weaving, a selection transmitter 54 for generating the selection signal S4 corresponding to the selected item for display, and a modulation circuit 56 for modulating an output signal of a transmitting circuit by the selection signal S4.

The item selector 52 includes a plurality of operation switches individually corresponding to the pieces of loom information which can be displayed in the display 40. The modulation circuit 56 performs amplitude modulation, frequency modulation or pulse modulation of the output signal of the generation circuit 22 in correspondence to the selection signal S4. It is, however, possible to modulate the selected signal S4 with the output signal of the generation circuit 22. After being amplified in the amplifier 24, the modulated signal is transmitted from the transmit antenna 26 as the transmit signal S1.

The distinction device 14 demodulates the selection signal in a demodulation circuit 58 on the basis of the output signal S3 of the receiving circuit 30, and the person engaged in weaving distinguishes a desired item for display in the discrimination circuit 32 on the basis of the demodulated signal S5. The distinguished item for display is supplied to the controller 38 as the distinction signal S2. The discrimination circuit 32 is similar to the device in FIG. 1 in that the owner of the portable transmitter 12 is distinguished by the signal level of the signal S5 to be within several meters from the loom.

In the information display apparatus 50, the person engaged in weaving can not only have the same action and effect as in the information display apparatus 10 but also change the loom information to be displayed in the display by utilizing the item selector 52 to properly select his desired item for display and change the loom information to be displayed in the display.

In the information display apparatus 50, it is possible to make the person engaged in weaving set a plurality of desired items for display at the same time. In this case, for example, it is possible to transmit a plurality of transmit signals respectively modulated by the selection signal at the same time or successively from the portable transmitter 12, and to demodulate the selection signal in the distinction circuit on the basis of each transmit signal, to supply a plurality of distinction signals corresponding to the item for display from the distinction device 14 to the controller 38 at the same time or successively, and further, to have the loom information corresponding to the distinction signal displayed in the display 40 in the same screen in the display unit 16, and to have the loom information corresponding to the distinction signal displayed in the display 40 in the same screen or successively according to a predetermined order of priority.

In all the foregoing embodiments, the distinction device 14 and the display unit 16 are disposed in every loom, but the receiving antenna 28, the receiving circuit 30 including the receiving antenna 28 or the distinction device 14 may be used by a plurality of looms.

Figure 5:
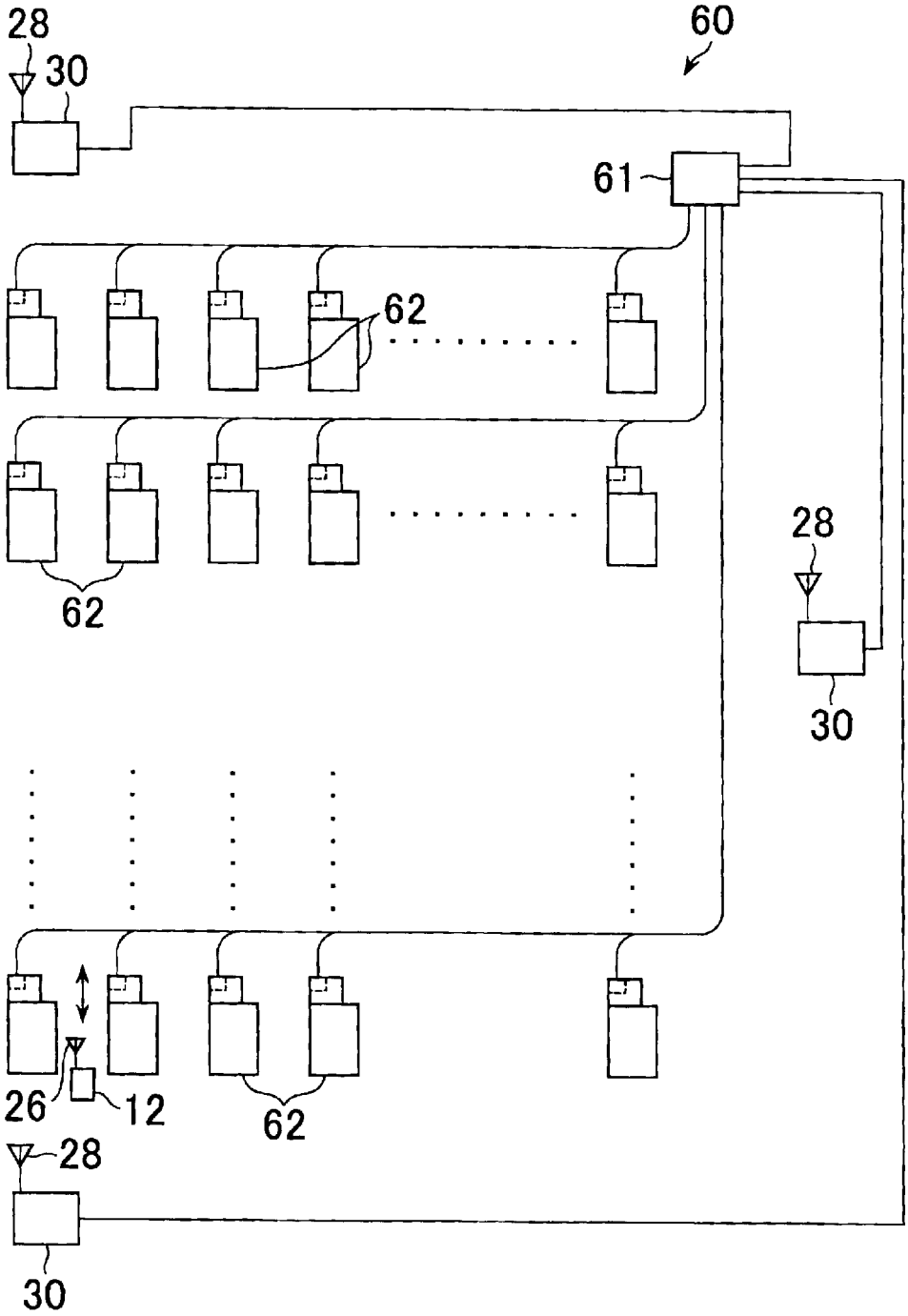
FIG. 5 is a schematic drawing showing an example of use of the information display unit according to the present invention.

Referring to FIG. 5, a plurality of looms 62 are installed in a weaving factory 60, and a plurality of receiving circuits 30 each including a receiving antenna 28 are arranged so as to surround those looms 62.

One each of the other circuits 61 (that is, including the discrimination circuit 32, the demodulation circuit 58 and the like) of the distinction device 14 except the receiving antenna 28 and the receiving circuit 30 is provided per plurality of looms. The display unit 16 is disposed in each loom. The discrimination circuit 32, besides generating the distinction signal S2 representing the kind of a person engaged in weaving, distinguishes to which loom the person approached and outputs the distinction signal S2 to the loom.

The loom to which the person approached can be distinguished on the basis of the level of the output signal S3 of the receiving circuit 30 by utilizing the fact that, the nearer the loom to the owner of the portable transmitter 12, the higher the level of the output signal S3 of the receiving circuit 30.

It is, however, possible to distinguish to which loom the person engaged in weaving approached, on the basis of the orientation of the signal inputted to the receiving antenna 28, the direction or position of the person, the distance from the portable transmitter 12 or the person to the loom and the like.

While the foregoing portable transmitter 12 is constituted, for example, to transmit a transmit signal at all times, it is also possible, by further providing a transmit button, to transmit a radio signal by operating the button.

It is also possible, instead of preparing as many portable transmitters as the number of users, to have different kinds of persons engaged in weaving share one portable transmitter 12.

Further, while it is desirable for a user, i.e., a person engaged in weaving to set freely items for display relative to the foregoing memory 42 or the portable transmitter 12, a manufacturer of a loom may set most suitable items for display for the user to utilize them as they are.

The present invention is not limited to the foregoing embodiments but can be variously modified without departing from the spirit thereof.

What is claimed is:

1. An information display apparatus of a loom, comprising:

data control means storing at least a plurality of pieces of loom information and capable of outputting the stored loom information;

display means for displaying in a screen the loom information to be outputted from said data control means; and distinction means for distinguishing a kind of a person engaged in weaving and outputting a distinction result to said data control means;

wherein in said data control means an item for display corresponding to said distinction result is preset; and wherein said data control means outputs the loom information relative to the item for display corresponding to said distinction result to said display means.

2. The information display apparatus as described in claim 1, wherein said distinction means includes a detected element which a person engaged in weaving carries and which represents a kind of the carrier, and a distinction portion for distinguishing the detected element.

3. The information display apparatus as described in claim 2, wherein said detected element includes a portable transmitter for generating a signal representing a kind of a carrier, and wherein said distinction portion includes a receiving circuit, and a discrimination circuit for discriminating the kind of said carrier on the basis of a received signal of said receiving circuit.

4. The information display apparatus as described in claim 2, wherein a plurality of said detected elements are prepared according to a kind of a person engaged in weaving, and wherein said distinction portion distinguishes the kind of the detected elements.

5. The information display apparatus as described in claim 1, wherein said distinction means includes a sensor for detecting physical features of said person engaged in weaving, and a distinction circuit for distinguishing the kind of said person engaged in weaving from a group of registered data which are previously registered.

6. An information display apparatus of a loom, comprising:

data control means storing at least plural pieces of loom information and capable of outputting the stored loom information;

display means for displaying in a screen the loom information to be outputted from said data control means;

transmission means, in which at least one of the items for display is stored, for transmitting the item for display and provided for a person engaged in weaving to carry; and discrimination means for discriminating the item for display upon receipt of a transmission signal from said transmission means;

wherein said data control means outputs the loom information relative to an item for display corresponding to a result of discrimination by said discriminating means.

7. The information display apparatus as described in claim 6, wherein a plurality of items of information are stored in said transmission means, wherein said transmission means is capable of transmitting selectively any of the plurality of items for display, and wherein said discriminating means discriminates the selected item for display selected on the basis of said transmission signal.

* * * * *